US011931850B2

(12) United States Patent
Baù et al.

(10) Patent No.: US 11,931,850 B2
(45) Date of Patent: Mar. 19, 2024

(54) SANDING MACHINE WITH TRANSVERSAL BELT

(71) Applicant: COSTA LEVIGATRICI S.P.A., Schio (IT)

(72) Inventors: Eligio Baù, Breganze (IT); Alessandro Costa, Schio (IT)

(73) Assignee: COSTA LEVIGATRICI S.P.A., Schio (IT)

( * ) Notice: Subject to any disclaimer, the term of this patent is extended or adjusted under 35 U.S.C. 154(b) by 944 days.

(21) Appl. No.: 16/956,126

(22) PCT Filed: Jan. 8, 2019

(86) PCT No.: PCT/IB2019/050116
§ 371 (c)(1),
(2) Date: Jun. 19, 2020

(87) PCT Pub. No.: WO2019/138315
PCT Pub. Date: Jul. 18, 2019

(65) Prior Publication Data

US 2021/0402544 A1 Dec. 30, 2021

(30) Foreign Application Priority Data

Jan. 9, 2018 (IT) ..... 102018000000625

(51) Int. Cl.
*B24B 21/08* (2006.01)
*B24B 27/00* (2006.01)

(52) U.S. Cl.
CPC ..... *B24B 21/08* (2013.01); *B24B 27/0023* (2013.01)

(58) Field of Classification Search
CPC ..... B24B 7/06; B24B 21/00; B24B 21/04; B24B 21/06; B24B 21/08; B24B 21/10;
(Continued)

(56) References Cited

U.S. PATENT DOCUMENTS 6,186,865 B1 * 2/2001 Thornton ..... B24B 21/08 451/8
8,574,036 B2 * 11/2013 Weiland ..... B24B 9/002 451/309

(Continued)

FOREIGN PATENT DOCUMENTS

DE 951 766 10/1956
DE 17182 A 6/1959

(Continued)

OTHER PUBLICATIONS

International Search Report, issued in PCT/IB2019/050116, dated Apr. 4, 2019.

(Continued)

*Primary Examiner* — Bryan R Muller
*Assistant Examiner* — Robert F Neibaur
(74) *Attorney, Agent, or Firm* — Birch, Stewart, Kolasch & Birch, LLP

(57) ABSTRACT

A sanding machine, in particular for processing wood surfaces, includes a support and transport plane for the forwarding of the workpieces to be processed; and a belt sanding unit with a transverse abrasive belt inside which a pressure pad is arranged obliquely. The pressure pad is divided into a plurality of pressure elements which can be actuated individually and are controlled by respective sensors that constitute a control beam. Methods are described for compensating the different distances between sensor and respective pressure elements that avoid adaptations of the position of the workpiece to be processed, in particular if the machine contains further non inclined processing units. The sanding machine is particularly suitable even for the processing of large workpieces.

25 Claims, 4 Drawing Sheets

(58) Field of Classification Search
CPC ..... B24B 21/12; B24B 21/14; B24B 21/16; B24B 21/20; B24B 21/22; B24B 49/10; B24B 49/12; B24B 49/16
USPC ..... 451/5, 6, 296, 299, 300, 303, 311
See application file for complete search history.

(56) References Cited

U.S. PATENT DOCUMENTS

| | | | | |
|---|---|---|---|---|
| 10,124,460 | B2 * | 11/2018 | Stagni | B24B 21/08 |
| 11,325,219 | B2 * | 5/2022 | Bettermann | B24B 49/10 |

FOREIGN PATENT DOCUMENTS

| | | | |
|---|---|---|---|
| DE | 1113391 | | 8/1961 |
| DE | 42 32 028 | A1 | 3/1994 |
| EP | 3 009 231 | A1 | 4/2016 |
| JP | 10-58297 | A | 3/1998 |
| WO | WO2004/009290 | A1 | 1/2004 |
| WO | WO2011/026806 | A1 | 3/2011 |

OTHER PUBLICATIONS

Written Opinion of the International Searching Authority, issued in PCT/IB2019/050116, dated Apr. 4, 2019.

* cited by examiner

Stato dell'arte

SANDING MACHINE WITH TRANSVERSAL BELT

TECHNICAL FIELD

The present invention relates to a sanding machine, in particular for processing wood surfaces, which comprises a support and transport plane for the forwarding of the workpieces to be processed and a frame which supports at least one belt sanding unit wherein the sanding unit comprises an abrasive belt which extends and rotates transversely with respect to the feed direction of said support and transport plane. Inside said abrasive belt a pressure pad is arranged suitable to press the belt against the workpiece to be processed. The pad is arranged with an inclination with respect to the extent of said abrasive belt.

STATE OF THE ART

Machines for processing flat or shaped surfaces, such as sanding, generally comprise one or more continuous, longitudinal or transverse belts, which perform the surface sanding in contact with the workpiece to be processed which passes under the rotating belt. Such sanding units, as other types of processing wood surfaces, are widely known to the expert and described, for example, in the ISO 19085-8:2017 standard. Longitudinal belts rotate in the feed direction of the workpiece or in the opposite direction, while the transverse belts rotate transversely with respect to the feed direction of the workpiece to be processed. The large surfaces processing, particularly in the case of the use of transverse belts, involves problems concerning long abrasive paths and exaggeratedly large pressure areas. In the German patent DE 951 766 the problem is solved by inclining the pressure pad inside the transverse belt so that a large abrasive area is covered with a smaller effective pressure area without engaging each portion of the abrasive belt such that to the affected area, fresh parts of the belt get to the concerned zone of the pad without being clogged with dust. An inclined position of the pad inside the belt decreases the abrasive path of each grain and reduces wear on the abrasive belt. In this sense, also the transverse belts described in the patent application DE 1 113 391 and in the patent DD 17182 work, which in turn allow the large surfaces processing, reducing the necessary supporting pressure, that is the pressure area. The abrasive path is no longer determined by the length of the pressure pad but by its width combined with its inclined position. Even a relatively narrow pad is able to cover the entire width of the abrasive belt with its inclination. Each abrasive grain is pressed only on one part of its path against the workpiece to be processed and performs an abrasive work.

In the aforementioned documents, the workpiece to be processed is introduced inclined with respect to the abrasive belt to compensate for the inclined position of the pad, which requires a manual and impractical insertion of the workpieces and, for example, also a correction of the workpiece position. if, after the belt with the inclined pad, a processing unit follows which is non-inclined with respect to the conveyor belt.

Other documents disclosing inclined pads are WO 2011/026806 A1 and WO 2004/009290 A1, while the documents DE 42 32 028 A1, EP 3 009 231 A1 and JP H10 58297 A propose non-inclined pressure pads subdivided into a plurality of pressure elements managed by a control beam in turn divided into a plurality of sensors. The systems proposed therein are not intended to compensate for an inclined position of the pad, but to determine the shape and sizes of the workpiece to be processed.

DISCLOSURE OF THE INVENTION

The object of the invention is to overcome the aforesaid drawbacks. A further object of the invention is the further reduction of the support pressure area in the transverse belt.

The aforesaid objects and others that become evident from the following description are achieved by a sanding machine, in particular for processing wood surfaces, which comprises:

(a) a support and transport plane for the forwarding of the workpieces to be processed;

(b) a frame which supports at least one belt sanding unit wherein (b-1) the sanding unit comprises an abrasive belt which extends and during operation rotates transversely, in particular perpendicularly, with respect to the feed direction of said support and transport plane, (b-2) inside said abrasive belt a pressure pad is arranged which is arranged with an inclination with respect to the extent of said abrasive belt and which is adapted to press the belt against the workpiece to be processed, wherein the pressure pad is divided into a plurality of pressure elements which can be actuated individually.

The sanding machine is characterized by the fact that the sanding machine further comprises:

(i) as a control beam a series of sensors, at least one sensor for each pressure element of the pad, wherein said beam is arranged parallel to said abrasive belt; and (ii) a control unit which controls the actuation of the single pressure elements according to the information received from the sensors, compensating the different distances between the sensor and the respective pressure element across the working width; and wherein (A) the compensation of different distances between the sensor and the respective pressure element in the control unit occurs by defining:

(I) the distance between the centre of the control beam and the centre of the pressure pad as zero point;

(II) distances smaller than said distance according to point (I) as value to be subtracted; and (III) distances greater than said distance according to point (I) as value to be added OR (B) the compensation of different distances between sensor and corresponding pressure element in the control unit takes place starting from one end of the control beam or of the pressure pad and considering the angulation while determining the distances between sensor and corresponding pressure element consecutively towards the other end.

Metal or plastic material surfaces processing can also be assumed. The support and transport plane is obviously suitable to convey the workpiece to be processed under the at least one sanding unit. In other embodiments of the invention, it is conceivable that along the path of the workpiece to be processed or along the length of the support and transport plane are arranged more processing units, e.g. other transverse belts according to the invention, transverse belts with non-inclined pads, longitudinal belts or units working with brushes, etc.; and this in the most varied combinations that the person skilled in the art chooses easily according to his/her needs.

In a preferred embodiment of the sanding machine according to the invention, this further comprises other processing units in which sectioned elements are provided, arranged inclined or not with respect to the extent of the control beam, wherein to each section is assigned one of said sensors. Each section can therefore be controlled by a respective sensor. With a single control beam, multiple sectioned elements can be managed, regardless of their inclined or not position.

The inclination therefore means an oblique position of the pad inside the transverse belt. The pad is consequently also inclined with respect to the feed direction of said support and transport plane and therefore does not have a direction perpendicular with respect to the feed direction.

Obviously, the pressure pad does not press the entire belt against the workpiece to be processed, but only the parts affected by the pad or the relative pressure elements of the sectioned pad.

The pressure pad division into a plurality of pressure elements qualifies it as a sectioned pressure pad. Advantageously, the pressure elements are movable only in the direction of their height, thus approaching or moving them away from the workpiece to be processed, but they cannot be rotated around the lifting and lowering axis. This can, for example, be achieved by their position adjacent to one another and with compatible shapes between adjacent elements. The fact that they can be actuated individually means that, preferably, they can be individually actuated defining the start, the duration and advantageously also the degree of the support pressure exerted by the abrasive belt on the workpiece to be processed.

Advantageously, the pad control beam is fixed and does not move along its longitudinal extent, thus the extent covering the working width, and cannot be inclined. The pad control system according to the invention does not require adaptation of the position of the control beam to the inclination of the pressure pad.

Advantageously, the control beam is arranged upstream of the transverse belt according to the invention and preferably to all the processing units of the sanding machine.

Advantageously, each sensor is essentially located (allowing a slight displacement due to the inclination of the pressure elements) in front of the respective pressure element.

Advantageously, both the control beam and the inclined pad cover the entire working width of the sanding machine, that is the abrasive belt.

The sanding machine according to the invention allows the processing of large workpieces with a transverse belt reducing the support pressure area and the abrasive path of the individual areas of the abrasive belt for the oblique position of the pad; moreover, with the individual management of the individual sections (pressure elements) of the pressure pad, it allows to react to the non-simultaneous arrival of all the parts of the workpiece to be processed under the abrasive belt and thus makes it possible to produce a high specific abrasive pressure.

Preferably, the control beam—detecting the arrival of the piece and verifying its shape and compensating for the different distances from each individual sensor to the relative pressure element and considering the workpiece feed speed—allows to operate the pressure element in the moment in which it must exert a support pressure on the workpiece to be processed. The control beam does not have to be adapted to the position, advantageously, it can also react to variations in the inclination of the pressure pad which entail the change of the distances between the sensor and the pressure element. With a single control beam, preferably fixed in its position, it is also possible to manage other processing units of the sanding machine, if present, which are arranged obliquely or parallel to the control beam, without having to correct the position of the workpiece to be processed during its path through the sanding machine.

Embodiments of the invention allow different inclination layouts, not only of different values of the inclination angle, but also by varying "the inclination direction": the inclination angle comprised between the leg formed by the extent of the abrasive belt and the leg formed by the extent of the pressure pad opens to the right or to the left. The terms "left" and "right" refer to the gaze direction in the feed direction of the workpiece to be processed.

Advantageously, the inclination can be inverted between the position with opening towards the right and the position with opening towards the left. The inversion can be performed with a relative motor device or by mounting the sanding unit with transverse belt in two different positions, inverting them by 180°.

In a very preferred embodiment of the invention, the pressing elements are actuated when the workpiece to be processed or its edge entering the transverse belt sanding unit is beyond the frontal edge of the pressure element. Preferably, the actuation occurs when the workpiece has at least reached the height of the centre of the pressure element. The frontal edge is defined as the edge facing the workpiece to be processed entering under the abrasive belt and as the centre of the pressure element the midpoint of the pressure element extent in the direction of the depth of the pad. Although in the case of transverse belts it is less evident than in longitudinal belts processing, the delay of the support avoids an exaggerated and oblique processing of the edges of the workpiece to be processed. Moreover, the fact that the distance between the pressure element and the sensor at the basis of the compensation carried out by the control unit is approximate, due to the extent of the pressure element (this is not a mathematical point) and its inclination, is compensated.

There are several methods to compensate for the unequal distances between the sensor and the corresponding pressure element along the working width. In a preferred first alternative of the invention, the compensation of the different distances between the sensor and the respective pressure element in the control unit occurs by defining:

(I) the distance between the centre of the series of sensors and the centre of the pressure pad as zero point;

(II) distances lower than said distance according to point (I) as the value to be subtracted; and (III) distances greater than said distance according to point (I) as the value to be added.

The centre of the control beam is intended as the midpoint of the width of the control beam and the centre of the pressure pad as the point corresponding to the midpoint of the control beam given that a pressure element is attributed to each sensor. This method is fast and well manageable with microprocessors currently on the market and usable for the usual feed speeds in the industry. Changes in the inclination gradations are also treatable with this method. Alternatively, distance measuring devices (for example with the aid of light) could directly determine the distance between the sensor and the pressure element.

Advantageously, this method allows an easy adjustment of the compensation even in an inversion of the inclination orientation simply inverting the sign of the values according to the points (II) and (III).

With another alternative method, the compensation of the different distances between the sensor and the respective pressure element in the control unit can take place starting from one end of the control beam or the pressure pad and considering the angulation in determining the distances between the sensor and the relative pressure element towards the other end consequently. This system has some delay in the response but is nevertheless feasible for non-high processing speeds.

For both methods, with reference to FIG. 3, it is described how the differences in the distances resulting from the inclination of the pad with respect to a straight position can be calculated. The choice of the centre of the pressure element to identify the distance of the pressure element from the control beam is an approximation since the pressure element is not a mathematical point but has dimensions which in addition meet the element to be processed in an oblique layout. For the processing to be performed with the sanding machine according to the invention and with the realization of a plurality of pressure elements of suitable sizes, for example with widths of the element which do not exceed a few centimetres (e.g., 4 cm, but here the expert easily identifies suitable sizes), such approximation is negligible anyway.

The sanding machine according to the invention is particularly suitable for large workpieces processing by resizing the forces and the support pressure areas, and this, by means of the control beam system and the sectioned pressure pad, also occurs automatically. Advantageously, the useful working width is equal to or greater than 1,350 mm, preferably equal to or greater than 2,200 mm. Advantageously, the useful width does not exceed 3,600-3,700 mm.

To further reduce the specific area of the support pressure and the respective abrasive paths of the individual portions of the abrasive belt and consequently the wear of the same and the filling of the spaces between the individual grains with dust (which is a cause for the increase of frictional heat), preferably a pressure belt with projections on the surface is inserted between the abrasive belt and the pressure pad and rotates during operation. Also, this pressure belt is a transverse belt.

According to a further aspect of the invention, a use of the sanding machine according to the invention is provided such that the frontal edge of the workpiece to be processed enters parallel to the extent of the abrasive belt (which in turn extends perpendicularly to the feed direction of the transport plane) under said abrasive belt. Unlike the state of the art mentioned at the beginning, the compensation system provided by the invention allows a "straight" insertion of the workpieces to be processed so that the workpieces coming out from the transverse belt with an oblique pad do not require to be straightened to enter subsequent non-inclined processing units and promoting the automatic management of sanding.

The features described for one aspect of the invention may be transferred mutatis mutandis to the other aspect of the invention.

Said objects and advantages will be better highlighted during the description of preferred embodiment examples of the invention given, by way of example and not of limitation. Embodiments of the invention are the object of the dependent claims. The description of the preferred embodiment examples of the sanding machine and its use according the invention is given by way of example and not of limitation, with reference to the accompanying drawings.

DESCRIPTION OF PREFERRED EXEMPLARY EMBODIMENTS

Figure 1B:
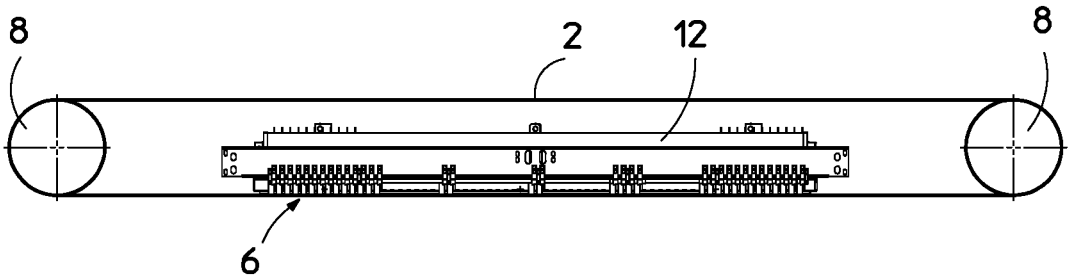
FIG. 1*b* illustrates the configuration of FIG. 1*a* in a front view in the feed direction of the workpieces to be processed.
Figure 1A:
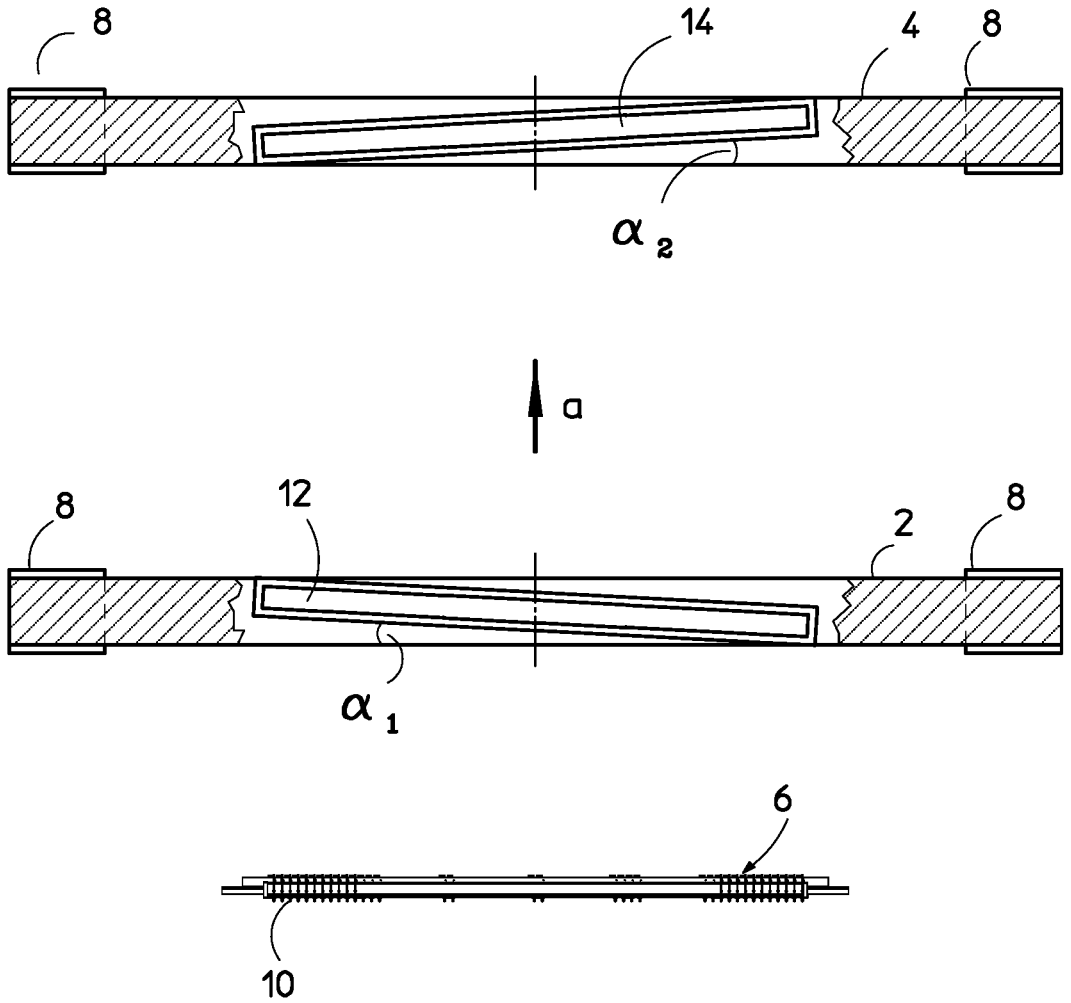
FIG. 1*a* illustrates in a top view the succession of two transverse belts and the relative control beam of an exemplary embodiment of the sanding machine according to the invention.

With reference to FIG. 1*a*, the succession of two transverse abrasive belts 2 and 4 and a relative control beam 6 can be seen. The belts 2 and 4 extend transversely to the feed direction (arrow a) of the workpieces to be processed and are realized as continuous belts operated (with a motor not depicted) and tensioned by the rollers 8. The control beam 6 comprises a series of sensors 10 (not all of them depicted) whose operation will be explained further on. In each belt 2, 4 a pressure pad 12 and 14, respectively, is arranged, which is visible in the figure by eliminating a piece of the belt. The pads 12, 14 are inclined with respect to the transverse extent of the belt 2, 4 having in the case of the belt 2 an inclination angle $\alpha_1$ which opens to the left and in the case of the belt 4 an inclination angle $\alpha_2$ which opens to the right.

The person skilled in the art easily identifies a suitable angulation.

FIG. 1*b* illustrates the configuration of FIG. 1*a* in a front view in the feed direction of the workpieces to be processed. The control beam 6 is in front of the pressure pads 12, 14.

Figure 2:
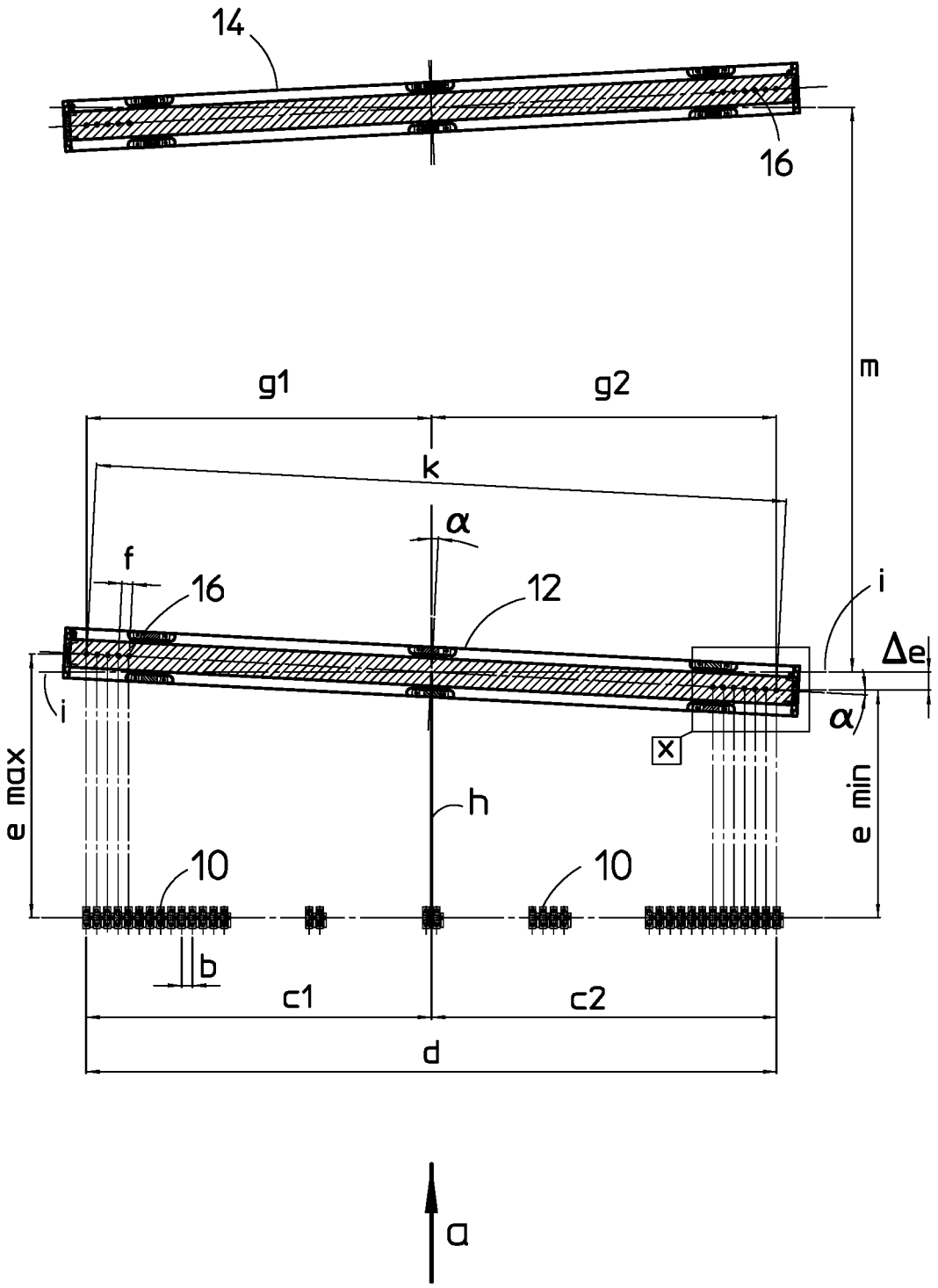
FIG. 2 depicts in a top view the sectioning of the pressure pads of the configuration according to FIG. 1 and the distance of the individual pressure elements with respect to the control beam.

FIG. 2 depicts in a top view the sectioning of the pressure pads 12, 14 of the configuration according to FIG. 1 and the distance of the individual pressure elements 10 (not all depicted) with respect to the control beam 6 which is arranged perpendicular to the feed direction (arrow a) of the workpieces to be processed. Each pad 12, 14 comprises a series of individual adjacent pressure elements represented by their respective centre 16 (central points of the width and depth of the pressure element). The distance b indicates the centre distance between two sensors 10 made as small wheels (e.g. 34 mm wide). With c1 and c2 two halves (e.g. 1105 mm) of the centre distance between the extreme sensors d (e.g. 2210 mm) are designated. For each pressure element 16 there is an opposite sensor 10. The distance between the centre of a pressure element 16 and its sensor 10 decreases from left to right, starting from a maximum distance $e_{max}$ and arriving at a minimum distance $e_{min}$. The difference between the maximum distance $e_{max}$ and the minimum distance $e_{min}$ is represented by $\Delta e$ (here 115.6 mm). The centre distance f of the centres of the pressure elements 16 (corresponds to the centre distance of the pistons to which the pressure elements are connected to exert a pressure) corresponds to the centre distance b (34 mm). The two halves g1 and g2 of the projection (on a line parallel to the base line i) of the centre distance k (here 2210 mm) between the pressure elements (i.e. their centres) extremes correspond in the exemplary embodiment shown to 1103.5 mm. The midpoint, i.e. the zero point where there is the average distance between the pressure element 16 and the sensor 10, is represented by the line h. The inclination of the pad 12 with respect to a base line i parallel to the extent of the control beam 6 is represented by the angle α which also manifests with respect to the line h. With m the distance between pads 12 and 14 is indicated.

Figure 3:
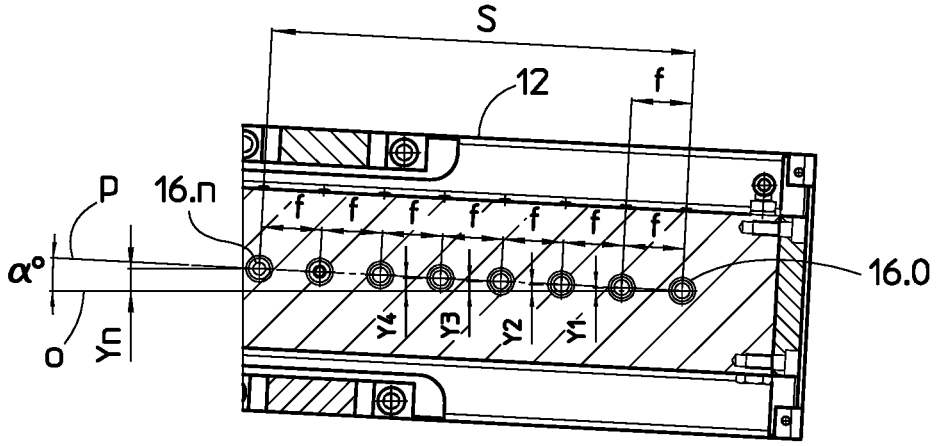
FIG. 3 shows the detail X of FIG. 2 which illustrates the variation of the distance of the pressure elements with respect to a base line which corresponds to the non-inclined position.

FIG. 3 shows the detail X of FIG. 2 which illustrates the variation of the distance of the centre of each pressure element 16 from the control beam (not depicted). With p a line passing through all the centres of all the pressure elements 16 is designated, whose centre distance is indicated, correspondingly to FIG. 2, with f. The centres are equidistant between each other. A line o starts in the pressure element closer to the control beam 16.0 and extends parallel to the extent of the latter. With y1, y2, y3, y4, . . . yn the distances of the individual pressure elements from the line o are indicated. With s the centre distance between the first pressure element 16.0 and the umpteenth pressure element 16.*n* is designated. The centre distance is generally calculated by multiplying the centre distance f with the number n of the respective pressure element to be considered with respect to the pressure element 16.0. The relative distance yn of the pressure element 16.*n* from the base line o, with respect to which the pad 12 is inclined with the angle α (here 3°), is calculated with the formula (1):

$$yn = f \cdot n \cdot \text{sen}\ \alpha \quad (1),$$

for visibility reasons each yn is drawn slightly shifted with respect to the real position at the height of the centre 16.*n*.

Figure 4:
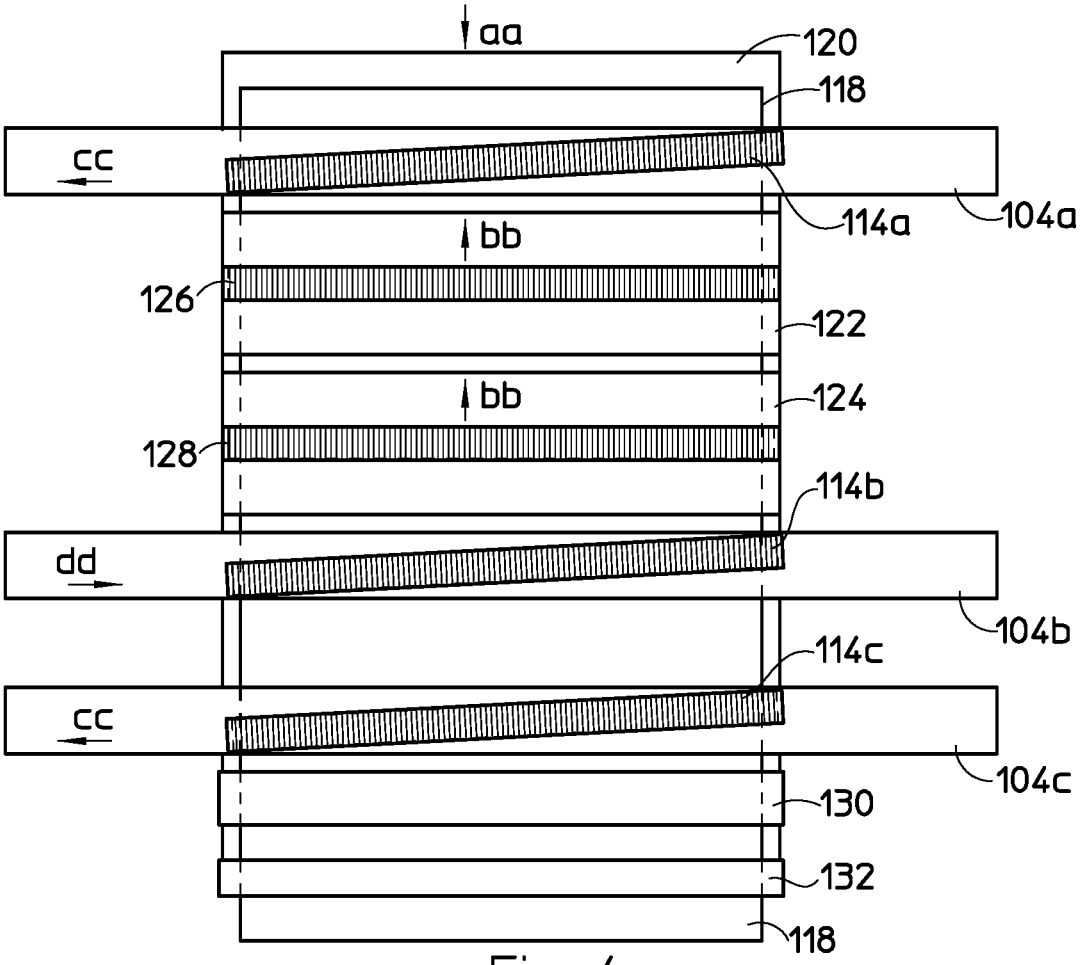
FIG. 4 shows in another exemplary embodiment of the sanding machine according to the invention the integration of transverse belts with inclined pressure pads with other processing units.

FIG. 4 shows in another exemplary embodiment of the sanding machine according to the invention the integration of transverse belts with inclined pressure pads with other processing units. One or more transverse belts with an inclined pad according to the invention can be integrated into sanding machines which also comprise other processing units. In exemplary form, FIG. 4 has in the feed direction aa workpieces to be sanded 118 arranged on a conveyor belt 120, a first transverse belt 104*a* with an inclined pressure pad 114*a*, two longitudinal belts 122, 124 arranged (as well as their sectioned pressure pads 126, 128) perpendicular to the feed direction aa, a second transverse belt 104*b* with an inclined pressure pad 114*b* and at a greater distance than the distances between the units described so far a third transverse belt 104*c* with an inclined pressure pad 114*c*, a unit of transverse strap brushes 130 for transverse cleaning and finally a blower 132 to eliminate the last traces of dust. The longitudinal belts 122 and 124 rotate in the opposite direction with respect to the feed direction aa of the conveyor belt 120, as indicated by the arrows bb. The rotation directions of the transverse belts 104*a*, 104*b*, 104*c* alternate between clockwise direction (arrows cc) and counter clockwise direction (arrow dd) with respect to the feed direction aa of the workpieces 118 to be processed. Obviously, other combinations of processing units are possible which are easily identified by the person skilled in the art according to the desired processing.

All the pads shown 114*a*, 126, 128, 114*b*, 114*c* are sectioned with the same number of pressure elements, all of which can be managed by the same sensor bar (not shown) parallel to the pads 126 and 128. A relative pressure element corresponds to each sensor in each pad. According to the invention, it is possible to control working elements inclined or not within the same sanding machine without having to provide control beams for each work unit, without having to adapt the position of the control beam and without having to correct the position of the workpiece to be processed between the individual processing units.

Figure 5:
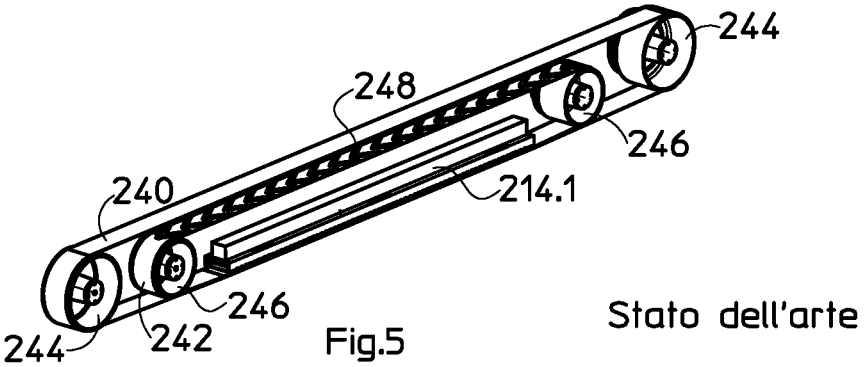
FIG. 5 shows in a perspective view a transverse belt with a pressure pad and a belt interposed according to the state of the art.

FIG. 5 shows in a perspective view a transverse abrasive belt 240 with a pressure pad 214.1 and an interposed belt 242 according to the state of the art. The belts 240 and 242 are rotated and tensioned by respective rollers 244 and 246 respectively. The interposed belt 242 has shaped projections 248 which make sure that not all the grains of the belt portion pressed by the pad 214.1 undergo the same force. This double tape principle and the use of a pressure pad, known with its advantages by the state of the art, can also be applied on transverse belts with inclined pads according to the invention. The interposed belt here is parallel to the extent of the pressure pad.

Figure 6:
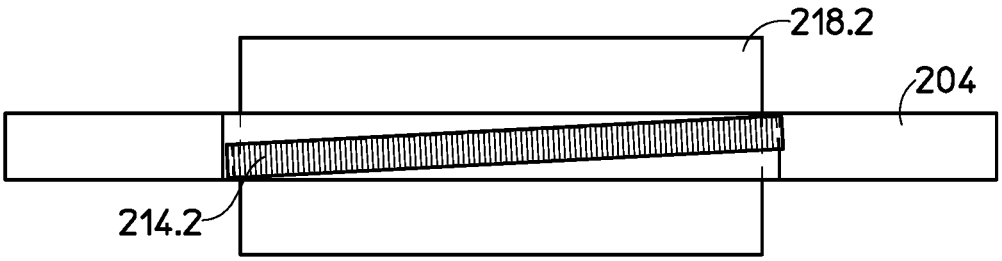
FIG. 6 shows in a top view a comparison between a transverse abrasive belt with a parallel pad and a transverse abrasive belt with an oblique or inclined pad.

FIG. 6 shows in a top view a comparison between a transverse abrasive belt 240 with a parallel pad 214.1 and a transverse abrasive belt 204 with an oblique or inclined pad 214.2. For both belts 204 and 240 the same type of pad can be used, only its position (214.1 or 214.2) changes with respect to the tape extent. In case of the belt 204 with inclined pad 214.2, the tape has a width greater with respect to the belt 240 with a parallel pad 214.1. The width of the belt is also defined by the degree of inclination of the pad. With the inclined pad 214.2, the abrasive surface and, of course, the area sanded in a period of time, hinted at by areas 218.1 and 218.2 which are being processed under the respective belts 240 and 204, increases.

Figure 7:
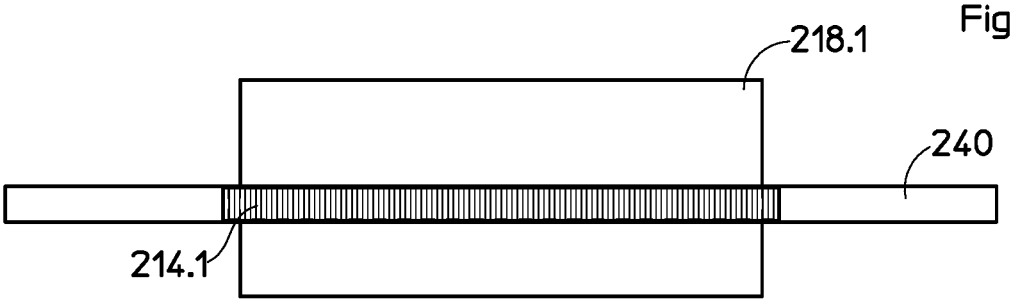
FIG. 7 shows in a perspective view a transverse abrasive belt with an inclined sectioned pad and the corresponding control beam parallel to the belt.
Figure 7:
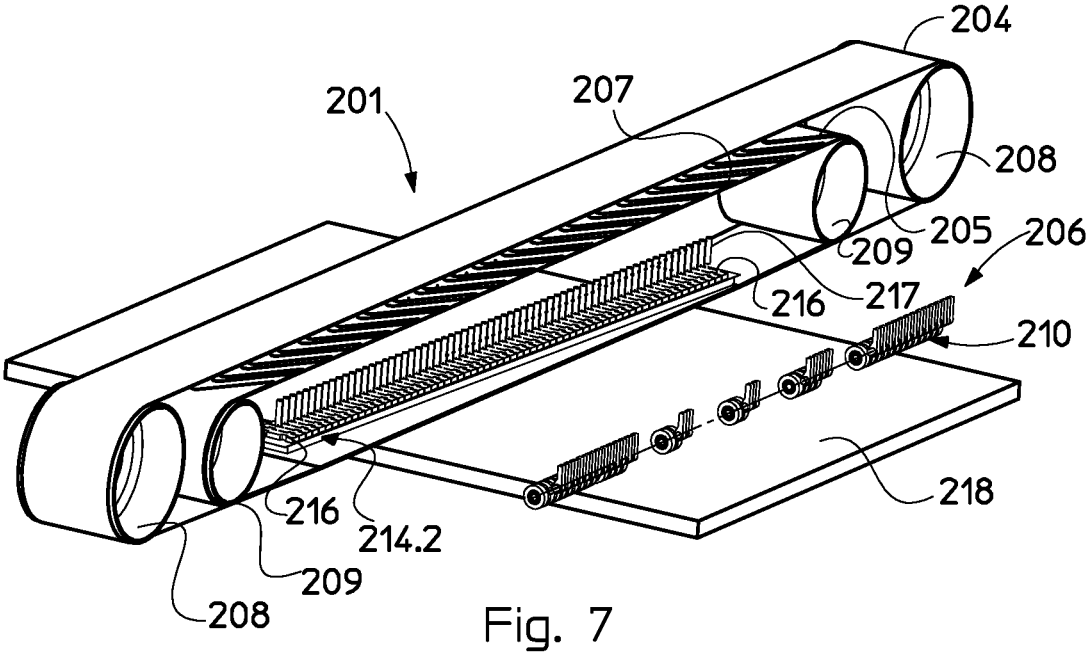

Finally, FIG. 7 shows in a more detailed perspective view the transverse abrasive belt 204 of FIG. 6 with an inclined sectioned pad 214.2 and the relative control beam 206 parallel to the belt 204. The pad is composed of a plurality of pressure elements 216 with relative pistons 217 for exerting pressure on the pressure elements 216. The belt 204 is operated and tensioned between two rollers 208. The control beam 206 is composed of a series of sensors 210 whose number corresponds to the number of the pressure elements 216. Between the pad 214.2 and the abrasive belt 204 a belt 205 with projections 207 is interposed with the above function and is tensioned and operated by two rollers 209. The sanding unit 201 composed of a transverse belt 204, an interposed belt 205 and a pressure pad 214.2 processes a workpiece 218.

The present invention solves the aforementioned problems and has provided a transverse belt sanding machine which allows the processing of large workpieces, in particular with working widths equal to or greater than 1,350 mm, preferably equal to or greater than 2,200 mm, reducing the support pressure area and thus reducing wear of the abrasive belt. The invention allows the automatic management of an inclined pad compensating for variations in the distance between the control beam and the pad and avoids corrections of the positions of the control beam or even of the workpiece to be processed, regardless of the processing units present in the sanding machine.

During the implementation stage, the sanding machine and its use, object of the invention, further modifications or embodiments not described and not shown in the attached tables may be carried out. If such modifications or such variants should fall within the scope of the following claims, they should all be considered protected by the present patent.

The invention claimed is:

1. A sanding machine, comprising:

(a) a support and transport plane for forwarding workpieces to be processed;

(b) a frame which supports at least one belt sanding unit, wherein (b-1) the sanding unit comprises an abrasive belt which extends, and during operation, rotates transversally, with respect to a feed direction of said support and transport plane, (b-2) inside said abrasive belt is arranged a pressure pad which is arranged with an inclination with respect to the extent of said abrasive belt and which is suitable to press the belt against the workpiece to be processed; wherein said pressure pad is divided into a plurality of pressure elements which are actuated individually;

wherein said sanding machine further comprises:

(i) a control beam comprising a series of sensors, at least one sensor for each pressure element of the pressure pad wherein said control beam is arranged parallel to said abrasive belt; and (ii) a control unit adapted to control the operation of the single pressure elements on information received from the sensors compensates different distances between each sensor and a corresponding pressure element across a working width, and wherein the compensation of different distances between each sensor and the respective pressure element in the control unit occurs by defining:

(I) a distance between a centre of the control beam and a centre of the pressure pad as a zero point;

(II) distances smaller than said distance according to point as value to be subtracted; and (III) distances greater than said distance according to point as value to be added.

2. The sanding machine according to claim 1, wherein the angle of said inclination which is comprised between the leg formed by the extent of the abrasive belt and a leg formed by the extent of the pressure pad opens to the right or to the left.

3. The sanding machine according to claim 2, wherein said inclination is invertible between a position which opens to the right and a position which opens to the left.

4. The sanding machine according to claim 2, wherein with an inversion of said inclination the sign of the values according to points (II) and (III) is inverted.

5. The sanding machine according to claim 1, wherein said pressure elements are actuated when the workpiece to be processed or an edge of the workpiece is located behind a frontal edge of said pressure element, the frontal edge is defined as the edge facing the workpiece to be processed entering under the abrasive belt and as a centre of said pressure element the midpoint of the extent of the pressure element in the direction of a depth of the pad.

6. The sanding machine according to claim 1, wherein between said abrasive belt and said pressure pad is arranged a pressure belt with projections on the surface.

7. The sanding machine according to claim 1, wherein said sanding machine further comprises processing units other than the at least one sanding unit comprising segmented elements wherein to each segment of said segmented elements is attributed one of said sensors.

8. The sanding machine according to claim 1, wherein the pressure elements are movable only in a direction of the pressure elements' height in a lifting or lowering axis, thus lifting or lowering the pressure elements from the workpiece to be processed, but the pressure elements cannot be rotated around the lifting and lowering axis.

9. The sanding machine according to claim 1, wherein the control beam is fixed and is not movable along a longitudinal extent of the control beam, thus the extent covering the working width, and cannot be inclined.

10. A sanding machine, comprising:

(a) a support and transport plane for forwarding workpieces to be processed;

(b) a frame which supports at least one belt sanding unit, wherein (b-1) the sanding unit comprises an abrasive belt which extends, and during operation, rotates transversally, with respect to a feed direction of said support and transport plane, (b-2) inside said abrasive belt is arranged a pressure pad which is arranged with an inclination with respect to the extent of said abrasive belt and which is suitable to press the belt against the workpiece to be processed; wherein said pressure pad is divided into a plurality of pressure elements which are actuated individually;

wherein said sanding machine further comprises:

(iii) a control beam comprising a series of sensors, at least one sensor for each pressure element of the pressure pad wherein said control beam is arranged parallel to said abrasive belt; and (iv) a control unit adapted to control the operation of the single pressure elements on information received from the sensors compensates different distances between each sensor and a corresponding pressure element across a working width, and wherein the compensation of different distances between each sensor and corresponding pressure element in the control unit takes place starting from one end of the control beam or of the pressure pad and considering consecutively the inclination angle ($\alpha$) which is formed between a base line that starts in the pressure element closer to the control beam and extends parallel to an extent of the control beam and a line passing through centres of all the pressure elements while determining the distances between each sensor and said corresponding pressure element towards an other end of the control beam wherein a relative distance (yn) of the pressure element from a base line, with respect to which the pad is inclined with the angle ($\alpha$), is calculated with the formula $yn=f \cdot n \cdot \text{sen}\ \alpha$ with f being the centre distance of the centres of the pressure elements and n being the number of the respective pressure element to be considered with respect to the pressure element closer to the control beam.

11. The sanding machine according to claim 10, wherein the angle of said inclination which is comprised between the leg formed by the extent of the abrasive belt and a leg formed by the extent of the pressure pad opens to the right or to the left.

12. The sanding machine according to claim 11, wherein said inclination is invertible between a position which opens to the right and a position which opens to the left.

13. The sanding machine according to claim 10, wherein said pressure elements are actuated when the workpiece to be processed or an edge of the workpiece is located behind a frontal edge of said pressure element, the frontal edge is defined as the edge facing the workpiece to be processed entering under the abrasive belt and as a centre of said pressure element the midpoint of the extent of the pressure element in the direction of a depth of the pad.

14. The sanding machine according to claim 10, wherein between said abrasive belt and said pressure pad is arranged a pressure belt with projections on the surface.

15. The sanding machine according to claim 10, wherein said sanding machine further comprises processing units other than the at least one sanding unit comprising segmented elements wherein to each segment of said segmented elements is attributed one of said sensors.

16. The sanding machine according to claim 10, wherein the pressure elements are movable only in a direction of the pressure elements' height in a lifting or lowering axis, thus lifting or lowering the pressure elements from the workpiece to be processed, but the pressure elements cannot be rotated around the lifting and lowering axis.

17. The sanding machine according to claim 10, wherein the control beam is fixed and is not movable along a longitudinal extent of the control beam, thus the extent covering the working width, and cannot be inclined.

18. A sanding machine, comprising:

(a) a support and transport plane for forwarding workpieces to be processed;

(b) a frame which supports at least one belt sanding unit, wherein (b-1) the sanding unit comprises an abrasive belt which extends, and during operation, rotates transversally, with respect to a feed direction of said support and transport plane, (b-2) inside said abrasive belt is arranged a pressure pad which is arranged with an inclination with respect to the extent of said abrasive belt and which is suitable to press the belt against the workpiece to be processed; wherein said pressure pad is divided into a plurality of pressure elements which are actuated individually;

wherein said sanding machine further comprises:

(v) a control beam comprising a series of sensors, at least one sensor for each pressure element of the pressure pad wherein said control beam is arranged parallel to said abrasive belt; and (vi) a control unit adapted to control the operation of the single pressure elements on information received from the sensors compensates different distances between each sensor and a corresponding pressure element across a working width, and wherein the compensation for unequal distances between each sensor and the corresponding pressure element along the working width is directly determined by distance measuring devices by measuring the distance between each sensor and the pressure element.

19. The sanding machine according to claim 18, wherein the angle of said inclination which is comprised between the leg formed by the extent of the abrasive belt and a leg formed by the extent of the pressure pad opens to the right or to the left.

20. The sanding machine according to claim 19, wherein said inclination is invertible between a position which opens to the right and a position which opens to the left.

21. The sanding machine according to claim 18, wherein said pressure elements are actuated when the workpiece to be processed or an edge of the workpiece is located behind a frontal edge of said pressure element, the frontal edge is defined as the edge facing the workpiece to be processed entering under the abrasive belt and as a centre of said pressure element the midpoint of the extent of the pressure element in the direction of a depth of the pad.

22. The sanding machine according to claim 18, wherein between said abrasive belt and said pressure pad is arranged a pressure belt with projections on the surface.

23. The sanding machine according to claim 18, wherein said sanding machine further comprises processing units other than the at least one sanding unit comprising segmented elements wherein to each segment of said segmented elements is attributed one of said sensors.

24. The sanding machine according to claim 18, wherein the pressure elements are movable only in a direction of the pressure elements' height in a lifting or lowering axis, thus lifting or lowering the pressure elements from the workpiece to be processed, but the pressure elements cannot be rotated around the lifting and lowering axis.

25. The sanding machine according to claim 18, wherein the control beam is fixed and is not movable along a longitudinal extent of the control beam, thus the extent covering the working width, and cannot be inclined.

* * * * *